US008495869B2

(12) United States Patent
Beissler et al.

(10) Patent No.: US 8,495,869 B2
(45) Date of Patent: Jul. 30, 2013

(54) POWER SYSTEMS WITH INTERNALLY INTEGRATED AFTERTREATMENT AND MODULAR FEATURES

(75) Inventors: Brent James Beissler, Lafayette, IN (US); Shawn William Cline, West Lafayette, IN (US); Michael Anthony Tripodi, West Lafayette, IN (US)

(73) Assignee: Girtz Industries Inc., Monticello, IN (US)

( * ) Notice: Subject to any disclaimer, the term of this patent is extended or adjusted under 35 U.S.C. 154(b) by 410 days.

(21) Appl. No.: 12/917,500

(22) Filed: Nov. 2, 2010

(65) Prior Publication Data

US 2012/0102929 A1 May 3, 2012

(51) Int. Cl.
*F01N 3/10* (2006.01)

(52) U.S. Cl.
USPC ..... 60/301; 60/274; 60/275; 60/280; 60/297

(58) Field of Classification Search
USPC ..... 60/274, 275, 280, 285, 286, 295, 60/297, 301, 303; 180/65.51, 309
See application file for complete search history.

(56) References Cited

U.S. PATENT DOCUMENTS

| | | | | |
|---|---|---|---|---|
| 4,992,669 | A | 2/1991 | Parmley | |
| 5,606,946 | A * | 3/1997 | Data et al. | 123/198 F |
| 5,693,300 | A | 12/1997 | Slone | |
| 6,082,101 | A | 7/2000 | Manaka et al. | |
| 6,192,676 | B1 | 2/2001 | Zurbig et al. | |
| 6,387,336 | B2 | 5/2002 | Marko et al. | |
| 6,550,250 | B2 | 4/2003 | Mikkelsen et al. | |
| 6,601,542 | B2 | 8/2003 | Campion | |
| 6,765,304 | B2 | 7/2004 | Baten et al. | |
| 7,081,682 | B2 | 7/2006 | Campion | |
| 7,221,061 | B2 | 5/2007 | Alger et al. | |
| 7,717,205 | B2 | 5/2010 | Kertz et al. | |
| 7,849,680 | B2 * | 12/2010 | Shaff et al. | 60/295 |
| 8,261,538 | B2 * | 9/2012 | Kistner et al. | 60/295 |
| 8,261,860 | B2 * | 9/2012 | Najt et al. | 180/65.21 |
| 2004/0118282 | A1 | 6/2004 | Alger et al. | |
| 2004/0265198 | A1 | 12/2004 | Biswas et al. | |
| 2010/0070117 | A1 * | 3/2010 | Siffert | 701/19 |
| 2010/0186381 | A1 * | 7/2010 | Charles et al. | 60/282 |
| 2010/0229539 | A1 * | 9/2010 | Timmons et al. | 60/297 |

OTHER PUBLICATIONS http://en.wikipedia.org/wiki/Selective_catalytic_reduction.
http://en.wikipedia.org/wiki/Diesel_particulate_filter.

* cited by examiner

*Primary Examiner* — Binh Q Tran
(74) *Attorney, Agent, or Firm* — Roberts IP Law; John Roberts

(57) ABSTRACT

Disclosed is a power system that may be housed inside a single ISO shipping container having standard outside dimensions. The system may include a power source and an internally integrated aftertreatment module that is removable as a unit and that comprises, for example, Particle Filters (PF), and/or Oxidation Catalysts (OC), and/or Selective Catalytic Reduction (SCR) systems. The power system may include other removable modules such as a power module comprising a generator, pump, chipper, chiller, or other power equipment, a container module for fuel, and a container module for reductant, both of which may be non-rectangular in cross-section. A system is also disclosed for providing on-site power in the absence of shore power.

15 Claims, 9 Drawing Sheets

POWER SYSTEMS WITH INTERNALLY INTEGRATED AFTERTREATMENT AND MODULAR FEATURES

TECHNICAL FIELD

This invention relates generally to power systems, and more particularly to power equipment systems and power generation systems with internally integrated aftertreatment, as well as such systems with modular features.

BACKGROUND

Regulatory agencies around the world have recently promulgated regulations strictly limiting the emission levels of internal combustion engines and, in particular, diesel engines that power various equipment such as electrical generators. These regulations have required manufacturers of engines and power generation equipment to use aftertreatment systems as an add-on to their power systems. For example, U.S. Pat. No. 7,221,061 B2 to Alger, et al., issued May 22, 2007 and incorporated herein by reference, discusses a power generating system having an aftertreatment system (process module) mounted to the exterior of a power generation system, as reproduced in FIG. 1 hereto. Such aftertreatment systems reduce the levels of emissions produced by the power generation systems and allow them to comply with applicable regulations.

The elements of an engine aftertreatment system are selected dependent upon: (i) the regulations in the region in which the system is to be used; (ii) the type of power source in the power system; and (iii) the application of the equipment, such as power equipment or power generation. For example, if the power source uses diesel fuel, some regulations may require that a Diesel Particulate Filter (DPF) be included in the aftertreatment system to reduce the particulate emissions of the power system. A DPF is a device designed to remove diesel particulate matter or soot from the exhaust gas of a diesel engine. A diesel-powered engine equipped with a properly functioning DPF will emit no visible smoke from its exhaust. DPFs need to be accessible because they typically require periodic maintenance. For example, a method must exist to access, clean, and/or replace the filter. In contrast, if the power source uses natural gas as fuel, a particulate filter is not required, but an oxidation catalyst or other system might be. Access to these all devices is required for maintenance, replacements and upgrades.

Whenever the power source burns a hydrocarbon-based fuel, exhaust gases may need to be purified using an aftertreatment system incorporating technologies such as a Particulate Filter (PF), Oxidation Catalysts (OC) and/or Selective Catalytic Reduction (SCR). In OC and SCR devices, catalytic combustion is used to break down pollutants in the exhaust stream into innocuous components.

Additionally, diesel engines manufactured in the United States on or after Jan. 1, 2011 are required to meet lowered NOx levels. All of the United States heavy duty diesel engine manufacturers (manufacturing engines generating more than, for instance, 900 brake kilowatts) have presently chosen to utilize SCR aftertreatment to achieve these lower NOx standards. This Includes Caterpillar (C32 and 3500 series models), Cummins (QST and QSK), and MTU. These SCR-equipped engines require the continual addition of Diesel Exhaust Fluid (DEF), a urea solution, to enable the process.

SCR is a means of converting nitrogen oxides, also referred to as NOx, with the aid of a catalyst into diatomic nitrogen, N2, and water, H2O. A reductant, typically anhydrous ammonia, aqueous ammonia or urea, is added to a stream or flue of exhaust gas and is adsorbed onto a catalyst. Carbon dioxide (CO2) is a reaction bi-product when urea is used as the reductant. The NOx reduction reaction takes place as the gases pass through a catalyst chamber. Before entering the catalyst chamber, the ammonia, or other reductant (such as urea), is injected and mixed with the exhaust gases. SCR systems must have a mixing section of sufficient length to achieve high NOx reduction. SCR systems typically have numerous elements or components, including one or more reductant storage tanks, lines, valves, pumps, vaporizers, mixers, nozzles, injectors, ductwork, heat exchangers, air compressors, air heaters and fans, as well as control systems. External power may be required to operate many of these components of SCR systems. However, shore power is not always available for independent operation of the SCR system.

Aftertreatment systems, especially those incorporating SCR systems, are usually large in proportion to the corresponding engines, and in the past have fit only outside of the housings containing the power system. The sheer size and complexity of these aftertreatment systems has previously prevented them from being able to be mounted in the same container as the power system. Mounting aftertreatment systems externally to power system containers adds size and complexity to the combined systems, rendering them difficult and expensive to transport and set-up.

Another problem with present externally-mounted aftertreatment systems is that they cannot easily be modified to attach to different types of engines, generators or power equipment. An advantage of the modular features of the present power system is that various combinations of engines, generators and/or power equipment can be readily replaced or substituted for other combinations of engines, generators or power equipment with few or no changes to its aftertreatment system.

The typical process of attaching aftertreatment systems to power equipment involves mounting individual components of the aftertreatment system to the outside of the housing of the unit containing the equipment. Aftertreatment systems may include several functional elements that must be mounted and interconnected with each other. Consequently, individual contractors or support personnel must travel to the site where the power equipment is to be located, determine the proper location for the respective components of the aftertreatment system, prepare the exhaust for the attachment of the aftertreatment elements, mount each aftertreatment element, and connect the aftertreatment elements to each other and to the exhaust of the engine. A final test is then necessary to check the efficacy of the installation, make repairs as necessary and retest. This process is both time consuming and expensive.

When an aftertreatment system is to be added to a portable power system, additional difficulties arise. Portable power systems are sometimes referred to as power modules. The top sides of most power modules are not strong enough to support the weight of an aftertreatment system. Therefore, a typical procedure for attaching an aftertreatment system to a power module includes designing and installing support structure and framing to the housing of the power module. The aftertreatment elements are then attached to the support structure. Adding supporting members to the housing increases the time and expense required to install the aftertreatment system.

Transportation problems are also inherent in the current method of adding aftertreatment systems to the outside of power systems. Individual aftertreatment elements are not easily transported via typical shipping methods. In addition, when supporting members are added to the exteriors of housings of portable power systems, the supporting members add width and/or length to the housings. Therefore, these modified housings are often too large to be shipped via conventional means. In fact, special permits are often required to transport such modified housings on highways.

U.S. Pat. No. 4,992,669 issued to Parmley on Feb. 12, 1991 (the '669 patent) discloses a modular energy system in which a driven unit is connected to a driving unit via a shaft. These modular units are attached to each other via locking assemblies. However, the units that are shown in the '669 patent are each the same size. Stacking such units on top of each other could result in wind loads on the system of sufficient strength to cause damage to the system. In addition, the driven units in the '669 patent do not provide support for internal engine processes but merely use the power created by the driving units.

The present invention, which includes internally integrated aftertreatment elements, solves one or more of the problems set forth above.

SUMMARY OF THE INVENTION

Space, size and complexity problems are solved by integrating into a single package, power equipment or power generation equipment, including such equipment as fuel tank and heat exchanger components, along with the required emissions control devices and systems. The invention provides the packaging solution while maintaining portability and ruggedness. Additionally, modular features of the present invention allow for parts servicing, component removal and component exchange.

One aspect of the invention described herein is a power system adapted to be transported as a single, comprising a housing that contains the power system, including: a power source capable of generating at least 100 kilowatts of brake power and that consumes a fuel and exhausts a gas; a power module adapted to be driven by the power source, wherein the power module comprises at least one of: an electrical generator; a pump; a chipper; a chiller; or an air compressor; and an aftertreatment system adapted to purify the gas exhausted from the power source. In various embodiments of the power system the housing may further contain a container module adapted to contain the fuel consumed by the power source. The container module may comprise a fuel tank having an outer perimeter around its cross-section that forms a non-rectangular polygonal shape. The housing may further contain a container module adapted to contain a reductant consumed by the aftertreatment system. Such a container module may comprise a reductant tank having an outer perimeter around its cross-section that forms a non-rectangular polygonal shape. In certain embodiments the housing is formed at least in part from an ISO shipping container, or shares the outer dimensions of an ISO shipping container sufficiently for the housing to be stacked with ISO shipping containers. In various embodiments an aftertreatment system may comprise at least one of: a PF system; an OC system; and/or a SCR system. In certain embodiments the power source expels heat to a radiator located centrally in the housing.

Another aspect of the invention described herein is a power system adapted to be transported as a single assembled unit, comprising: a power source capable of generating at least 100 kilowatts of brake power; and a power module adapted to be driven by the power source, wherein the power module comprises at least one of: an electrical generator; a pump; a chipper; a chiller; or an air compressor; wherein the power source and the power module are together removably attachable as a single unit to the power system. In certain embodiments the power source exhausts a gas, and the power system may further include an aftertreatment module adapted to purify the gas exhausted from the power source, where the aftertreatment module is removably attachable as a single unit to the power system. In certain embodiments the power source consumes a fuel, and the power system may further include a container module adapted to contain the fuel consumed by the power source, the container module removably attachable as a single unit to the power system. In certain embodiments the aftertreatment module consumes a reductant, and the power system may further include a container module adapted to contain the reductant consumed by the aftertreatment module, where that container module is removably attachable as a single unit to the power system. In various embodiments the power system may include an aftertreatment module that comprises at least one of: a PF system; an OC system; and/or an SCR system. In certain embodiments the power system is contained inside an ISO shipping container. In other embodiments the power system is contained inside a container that shares the outer dimensions of an ISO shipping container sufficiently for the container to be stacked with ISO shipping containers. The power source may expel heat to a radiator located inside the power system, in one embodiment centrally inside.

An additional aspect of the invention described herein is a power system adapted to be transported as a single unit, comprising: a power source that exhausts a gas and is capable of generating at least 100 kilowatts of brake power; an SCR system; and a source of on-site electrical power internal to the power generation system and sufficient to properly start up or properly shut down the SCR system without a supply of power external to the power system. In certain embodiments the internal source of on-site electrical power is at least one battery, which may be charged by an alternator driven by the power system, a solar panel, or a wind-driven alternator. The power system may further or alternatively comprise a source of on-site pneumatic power internal to the power system and adapted to purge reductant from reductant transmission lines in the SCR system while shutting down the SCR system without a supply of power external to the power system.

In various aspects of the invention, the power module may include any combination of suitable engine-driven power equipment, such as, for instance, a generator, a pump system, a chipper, chiller, or air compressor. In some embodiments the generator is capable of generating at least 100 kilowatts of electrical power (kWe).

The foregoing summary is illustrative only and is not meant to be exhaustive. Other aspects, objects, and advantages of this invention will be apparent to those of skill in the art upon reviewing the drawings, the disclosure, and the appended claims.

DETAILED DESCRIPTION

Figure 1:
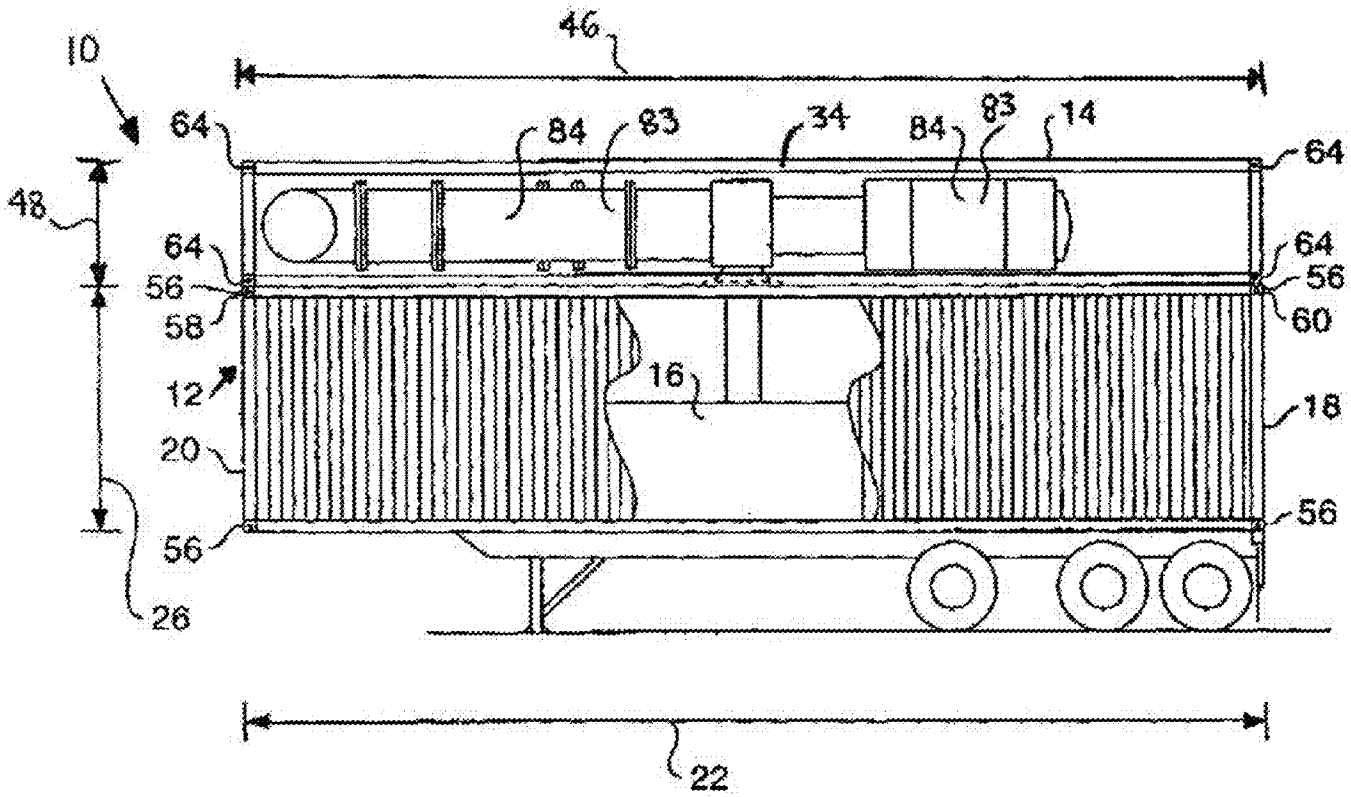
FIG. 1 is a side view of a power system having a power module and an aftertreatment module mounted externally according to an example prior art system.

Referring to FIG. 1, a power system 10 is shown with an aftertreatment module 14 mounted externally according to the prior art. The power system 10 includes a power module 12 and a process module 14 connected to the outside of the power module 12 according to the prior art. The power module 12 typically includes a power source 16. The power source 16 may be a spark-ignition engine, a compression-ignition engine, a homogenous charge compression ignition engine, a turbine, a fuel cell, or any other power-generating apparatus. As shown in FIG. 1, the power module 12 may be a portable power generation system. However, as used herein "power module" may also include other power generation systems, including custom-built power generation systems, fixed location power generation systems, and portable power generation systems that have been removed from trailers.

The power module 12 in FIG. 1 includes a housing 18 formed from an ISO container 20. As used herein, "ISO container" shall mean a container at least substantially meeting the specifications set forth by the International Standardization Organization, for instance, standard ISO 688. The housing 18 of the power module 12 in FIG. 1 consists of a 40-foot ISO container 20, having a length dimension 22 of approximately 40 feet, a width dimension 224, shown in FIG. 3, of approximately 8 feet, and a height dimension 226 of approximately 9 feet.

Figure 2:
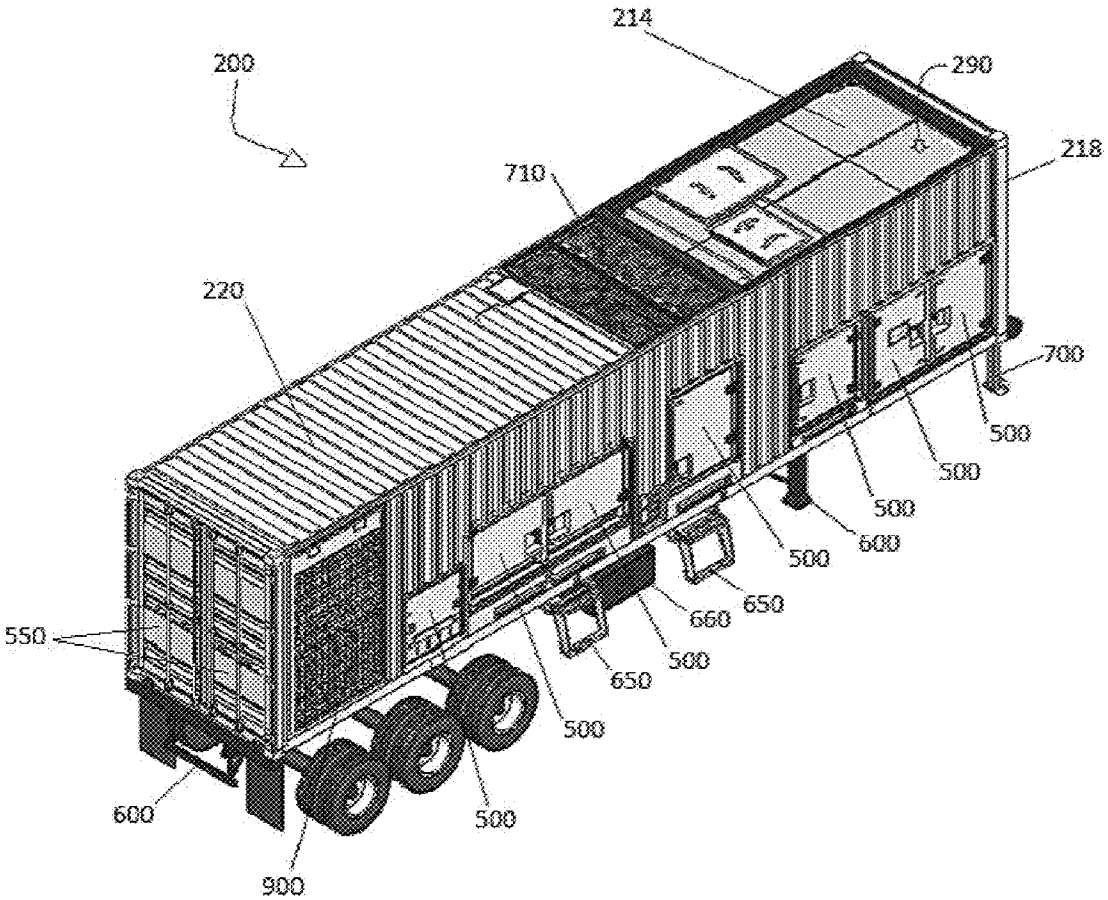
FIG. 2 is a perspective view of one embodiment of a power system incorporating various aspects of the invention.

Referring to FIG. 2, a power system 200 is shown with an aftertreatment module 214 mounted within the interior of a housing 218. In various embodiments the housing 218 may comprise a 40-foot ISO container 220, having a length dimension 222, shown in FIGS. 5 and 6, of approximately 498 inches, a width dimension 224, shown in FIG. 4, of approximately 96 inches, and a height dimension 226, shown in FIG. 4, of approximately 162 inches. However, ISO containers 220 having other length dimensions, width dimensions, and height dimensions may be used as the housing 218. Examples of ISO container nominal length dimensions include 20 feet, 30 feet, 40 feet, 45 feet, 48 feet, and 53 feet. Examples of ISO container nominal height dimensions (less chassis and wheels) include 8 feet, 8.5 feet, 9 feet, and 9.5 feet. These are nominal dimensions that may in practice vary due to manufacturing variations. The housing 218 may alternatively consist of other enclosures or of containers other than ISO containers.

Figure 3:
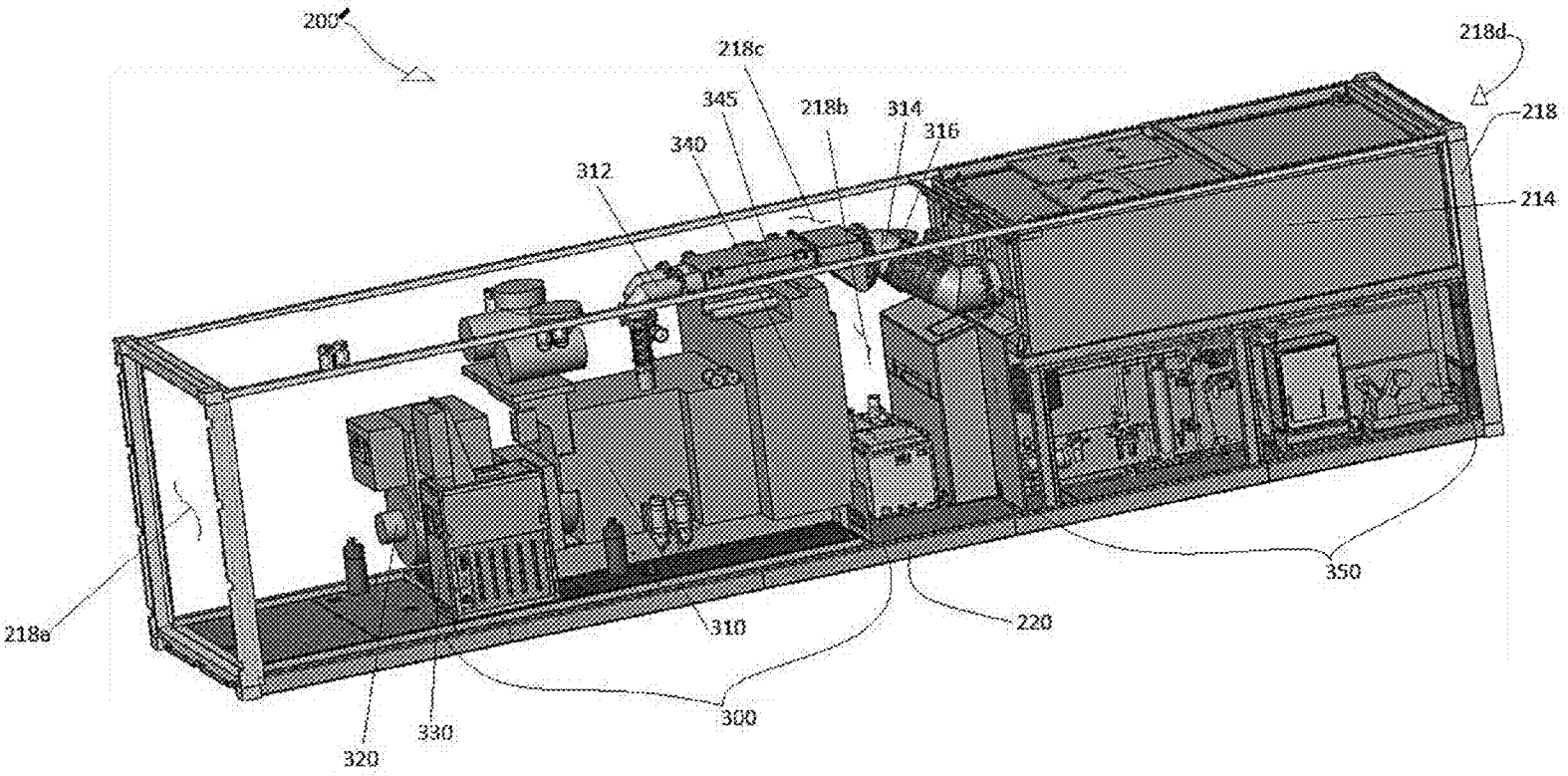
FIG. 3 is a perspective view of the power system of FIG. 2, with sides and top removed to provide a view of the interior.
Figure 9:
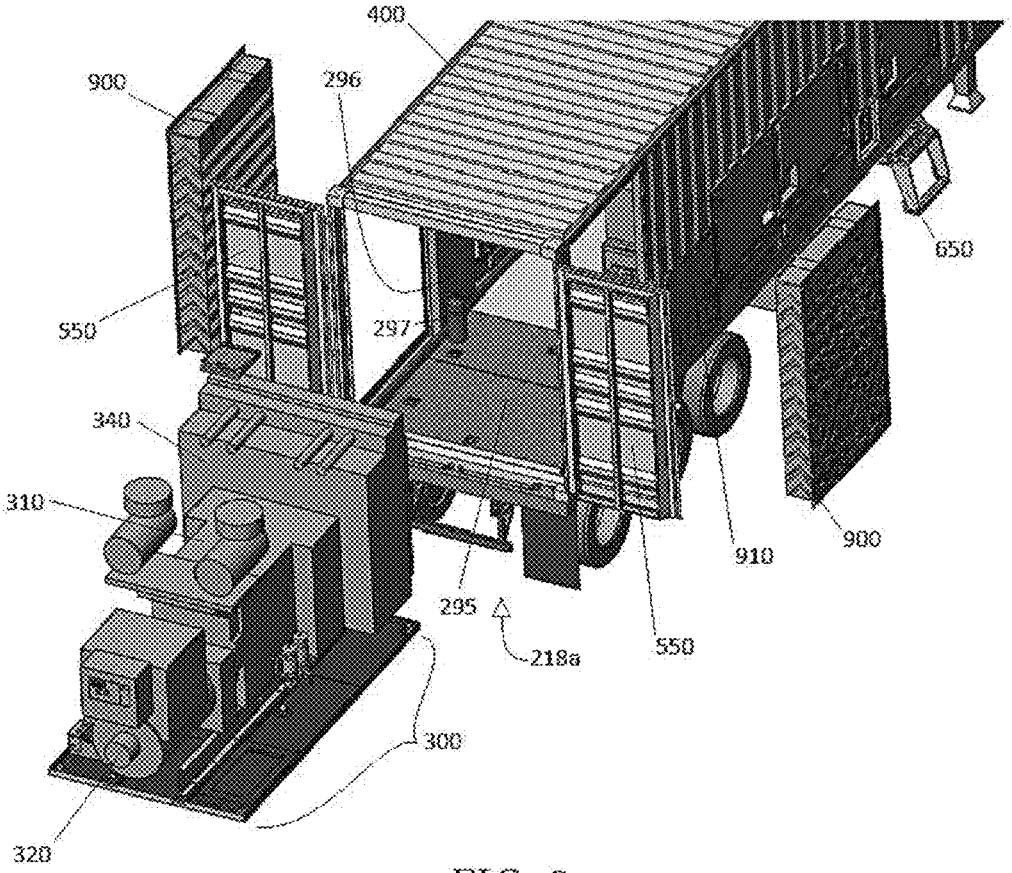
FIG. 9 is a partial perspective view of the power system of FIG. 2, showing a power source and power module being removed together as a unit through the back of the housing.

Turning to FIG. 3, a power system 200' is shown with an aftertreatment module 214 mounted within the interior of a housing 218 formed from the perimeter frame and floor of a 40-foot ISO container 220 without side or top panels, any of which panels may or may not be used partially or wholly in various embodiments. Power systems 200 and 200' may otherwise be the same, and each may include a power source 310 and power module 320 that are together removably attachable as a single unit 300 to the housing 218. FIG. 9 shows such a unit 300 being removed from the back 218*a* of the housing 218 through open doors 550. In the example shown in FIG. 3, a power source such as an engine 310 drives a power module 320 such as a generator set, and at least these elements are together removably attachable as a single unit 300 to the power system 200.' A radiator assembly 340 may also be removably attachable as part of single unit 300. Various aspects of the power system 200' may be controlled by an electrical control panel 330. Engine 310 may be a spark-ignition engine or a compression-ignition engine. Alternately, engine 310 can be a turbine, a fuel cell, or any other power-generating apparatus. The engine 310 may be positioned toward the interior 218*b* of the housing 218, while the generator set 320 and electrical control panel 330 may be positioned toward the exterior 218*a* of the housing 218 to provide easy access for a user (not shown). In one embodiment the engine 310 and generator set 320 is a diesel-fueled, 1,000 electric kilowatt (kWe) system, with 1600 A auto-paralleling breaker, 480V, 3-phase output, and a PCC300 digital controller. Alternatively the generator set may be capable of generating at least 100 kilowatts of electrical power (kWe). In certain embodiments the engine 310 includes a radiator assembly 340 located on the interior side 218*b* of the engine 310. Heat from the radiator assembly 340 is expelled toward the interior side 218*b* and then upwards through the roof or ceiling 218*c*, all as shown in FIG. 3. Hot exhaust flows through duct 314 into aftertreatment module 214, which is removably coupled to the housing 218 as a unit. Locating the radiator assembly 340 toward the center of the container 218*b* instead of near the end 218*a* of the container may in certain embodiments allow users to enter through standard shipping container doors 550 and manipulate the control system 330 without exposing themselves or the electronics of the control system 330 to the heat of the radiator assembly 340.

In other embodiments, power systems 200 may be provided that replace or augment power module 320 with different power equipment. For example, in the field of power equipment and particularly diesel-engine-driven equipment, instances may arise where the equipment is preferably provided in the form of a containerized power system, for instance to prolong operating time when fuel supply is scarce. For example, in certain embodiments, a portable engine-driven pump system (not shown) may be desired for, among other things, dewatering flood areas or for drought relief pumping. In those instances, a pump, such as a 12" suction trash pump could be used as a power module in place of or in addition to generator set 320, and a John Deere 153 hp engine, for instance, could be used as the engine 310. Such a power system 200 could house both a modular fuel tank and emissions control system for the engine 310 while providing access to plumbing lines (not shown).

In further embodiments, a portable, containerized, engine-driven chipper (not shown) may be desired for extended time use or for emergency clearing of debris. In those instances, a shredder or chipper (not shown) such as a Salsco Model 818, for example, could be used as a power module in place of or in addition to generator set 320.

In still other embodiments, a portable, containerized, engine-driven chiller (not shown) may be desired for certain applications. In those instances, a chiller (not shown) such as a Tecogen Model 23L, for example, could be used as a power module in place of or in addition to generator set 320. As will be evident to persons of skill in the art, any other suitable engine-driven power equipment, such as an air compressor (not shown), can be used as a power module, and such alternatives are expressly contemplated. Further, various combinations of such power modules 320 can be used together in a power system 200, as available space and engine power permit.

With further reference to FIG. 3, the aftertreatment module 214 may comprise a catalytic NOx reduction device, muffling components, a urea injection module, an emissions monitoring system, a urea tank, an air compressor, an oxidation catalyst, a particulate trap, ductwork, or any other device or apparatus useful in the process of the reduction of an emission from the power module 320 or the process of removal of a certain substance from an exhaust of the power source 310. For example, in various embodiments the aftertreatment module 214 may comprise one or more SCR systems, and/or OC systems, and/or PF's, and/or any other suitable aftertreatment elements, such as a muffler. Aftertreatment module 214 may include an internally mounted critical grade exhaust silencer. After being treated in aftertreatment module 214, the exhaust gases in this example embodiment exit through upwardly-turned exhaust duct 316 and exit upwards through the roof or ceiling 218*c* of the housing 218. Thermal exhaust wraps may be used throughout the exhaust train to either prevent heating of other components in the container or to retain essential heat in the exhaust for the proper performance of the aftertreatment device.

Figure 7:
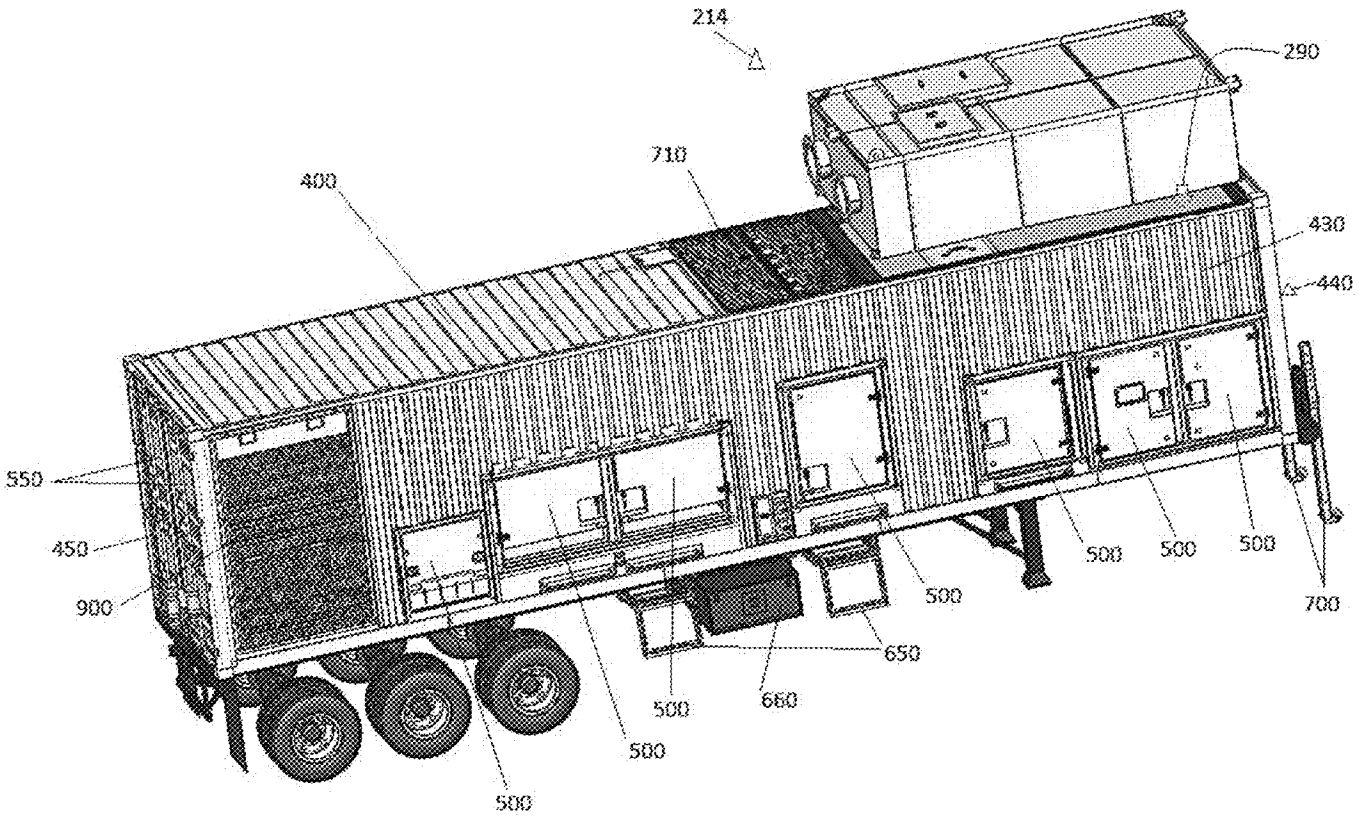
FIG. 7 is a perspective view of the power system of FIG. 2, showing an aftertreatment module being removed through the roof of the housing.

In certain embodiments the aftertreatment module 214 may comprise a PF that is a DPF device designed to remove diesel particulate matter or soot from the exhaust gas of a diesel engine. Wall-flow diesel particulate filters may be used for example, which usually remove 85% or more of the soot, and can at times (heavily loaded condition) attain soot removal efficiencies of close to 100%. Depending on the engine, DPF devices may be required to meet emissions regulations. One or more DPFs may be internal to aftertreatment module 214. Alternately, DPFs may be positioned proximate the aftertreatment module 214 or where space permits. DPFs may be positioned to be accessible through one or more access doors 500, shown in FIG. 5, and/or rear doors 550, and/or by removing the aftertreatment module 214 through an opening 290 in the housing 218, as depicted in FIG. 7, to access, clean, and/or replace the filter. PF filters (such as DPF) may be single-use (disposable), or may be designed to burn off the accumulated particulate, either through the use of a catalyst (passive), or through an active technology, such as electrical heating elements or a fuel burner. An alternative to including the PFs in aftertreatment module 214 is to provide one or more separate modules containing just the particulate filter elements themselves. Such separate unit(s) would remain in fluid communication with module 214.

In various embodiments the aftertreatment module 214 may further or alternatively comprise OC systems. In certain embodiments Diesel Oxidation Catalyst (DOC) systems (a type of OC) may be used, which break down hydrocarbons and carbon monoxide in the exhaust stream into innocuous components. OC elements (not shown) can also be either internal to aftertreatment module 214, or separated from module 214 into an independent chamber (not shown) in fluid communication with module 214.

In various embodiments the aftertreatment module 214 may further or alternatively comprise SCR. SCR is a means of converting nitrogen oxides, also referred to as NOx, with the aid of a catalyst into diatomic nitrogen, N2, and water, H2O. The NOx reduction reaction takes place as the exhaust gases pass through a catalyst chamber in the aftertreatment module 214. Before entering the catalyst chamber, a reductant (such as urea) is injected and mixed with the exhaust gases. Chemical equations for a stoichiometric reaction using a nitrogen based reductant may include: $4NO+4NH_3+3O_2 \rightarrow 4N_2+6H_2O$; $2NO_2+4NH_3+3O_2 \rightarrow 3N_2+6H_2O$; $NO+NO_2+2NH_3 \rightarrow 2N_2+3H_2O$. SCR systems should have a mixing section of sufficient length to achieve high NOx reduction. SCR systems typically require numerous elements or components, including one or more reductant storage tanks, lines, valves, pumps, vaporizers, mixers, nozzles, ductwork, heat exchangers, air compressors, air heaters and fans, all of which is shown generally as container module 350. Mixing sections may be inclusive in module 214 or designed as a separate chamber (not shown) in fluid communication with module 214.

External power from an electric utility, also known as "shore" power, is typically required to operate many of the aforementioned components of SCR systems, as well as to power the control systems for the power system 200, lighting, and the like. However, shore power is not always available for independent operation of a power system. One embodiment of the present invention overcomes this problem by providing on-site power using one or more batteries or other electrical energy storage devices that may be charged, for instance, by an on-board battery charger that may be powered from outside shore power when available, or from the electricity generated by a separate alternator (not shown) driven by the engine 310, or by the power system 200 itself. Alternatively, the batteries or other electrical storage devices may be charge by a one or more solar panels, wind-driven alternators, or other alternative power generation means. An on-site power source can alternatively provide AC and/or DC electricity, including three-phase electricity, for instance through a service panel with a variety of breakers. Should system 200 be a power generation system with this feature, it may be capable of proper shutdown when shore power has been either been terminated from the system or is not available. In another embodiment, provided is an air receiver (not shown) with pneumatic control components adapted to allow purging of the reductant from the reductant lines (not shown) regardless of the availability of shore power (for instance by storing pressurized air). For purposes of this disclosure and the appended claims, the terms "generator" and "alternator" are to be understood as both meaning "alternator and/or generator" except where otherwise indicated, to give the disclosure and claims their broadest reasonable meaning.

Figure 8:
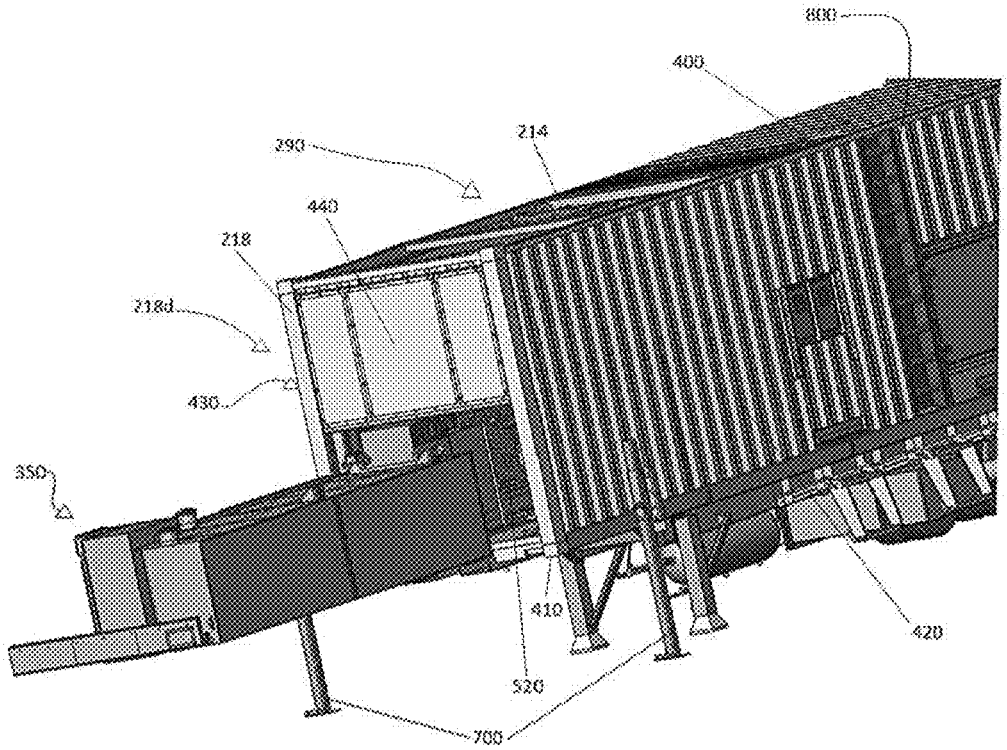
FIG. 8 is a partial perspective view of the power system of FIG. 2, showing a fuel tank being removed through the front of the housing.

Container module 350 may be removably coupled to the housing 218 as a unit, and may include one or more reductant storage tanks for the aftertreatment module 214, and/or one or more fuel storage tanks for the engine 310, as well as associated hardware such as pumps, compressors, filters, heaters, plumbing, electronics and the like. FIG. 8 shows container module 350 being removed as a unit from the front end 218*d* of the housing 218 through an access portal 520 that may at other times be covered with a panel 500 (not shown). The reductant and/or fuel storage tanks in container module 350 may be double-walled, may include leak monitoring systems, and to save space or make room for other components may have cross-sections other than rectangular. For example, reductant and/or fuel storage tanks in container module 350 may have outer perimeters that define trapezoidal, triangular, or other non-rectangular shaped cross-sections (or rectangular or square shaped cross-sections).

A specific example of a fuel storage system will now be described. It will be evident to persons of skill in the art that the following description is an example only, and other dimensions, configurations and materials may be used. In one example, a fuel storage system may include a container module 350 comprising a 1250 usable gallon, double wall, UL 142 or 2085 listed fuel tank, with six-position float-style level probe, overfill probe and audible alarm. An exterior fuel fill panel may be provided in the housing 218 which may include a four inch diameter neck fill opening, an external six-position fuel level monitoring panel and overfill alarm, as well as a spill catch basin and lockable weather-sealed door. Additionally, container module 350 may include a spill containment pan with a fuel/water separator installed therein. Primary and secondary tank drains may be plumbed to the exterior of the housing 218. Auxiliary fuel supply and return piping may be plumbed to the sidewall of the housing 218 with shut-off valves. Container module 350 may include, for instance, a 22.5 GPM, 40 psi cast iron positive displacement gear pump and 1.5 horsepower electric motor to pump fuel from the container module 350 to the engine 310.

A specific example of a reductant storage system will now be described. It will be evident to persons of skill in the art that the following description is an example only, and other dimensions, configurations and materials may be used. In one example of a reductant storage system (for a reductant such as urea), the container module 350 may comprise a 120 usable gallon, double-wall, stainless steel UL 142 listed tank, with six-position float-style level probe, overfill probe and audible alarm. An exterior fill panel may be provided in the housing 218 which may include a four inch diameter stainless steel neck fill opening, an external six-position level monitoring panel and overfill alarm, as well as a spill catch basin and lockable weather-sealed door. Additionally, container module 350 may include an additional spill containment pan with a fuel/water separator installed therein. Primary and secondary tank drains may be plumbed to the exterior of the housing 218. Container module 350 may include, for instance, a stainless steel three kilowatt urea circulation heater and thermostat, as well as an 8 GPM stainless steel positive displacement pump and 10 micron, stainless steel full flow urea filter. Such example fuel and reductant storage systems may for instance allow a power system 200, such as a 1000 kw power generation system, to run continuously for long periods of time at full load.

Figure 4:
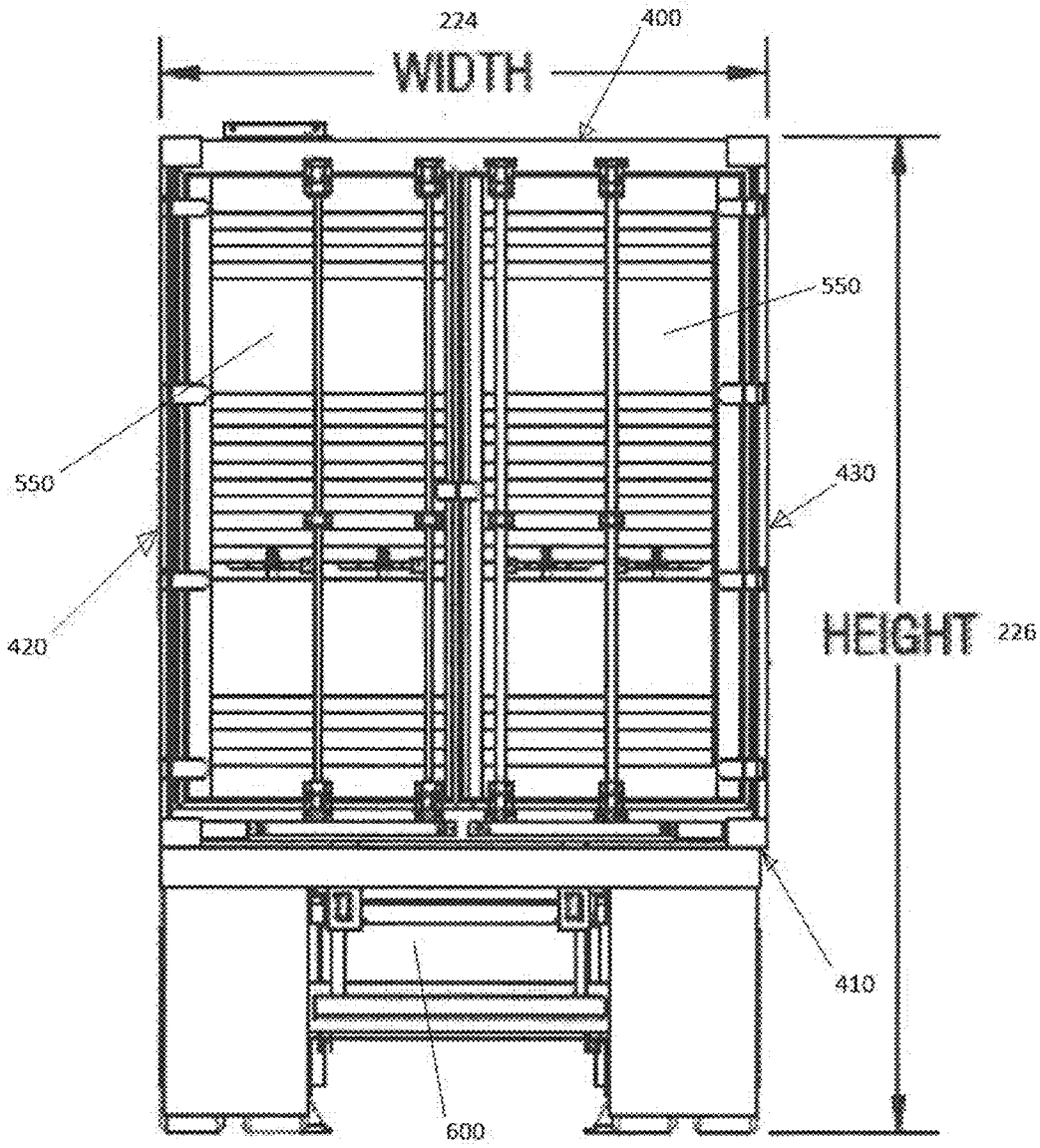
FIG. 4 is a back side view of the housing of the power system of FIG. 2.
Figure 5:
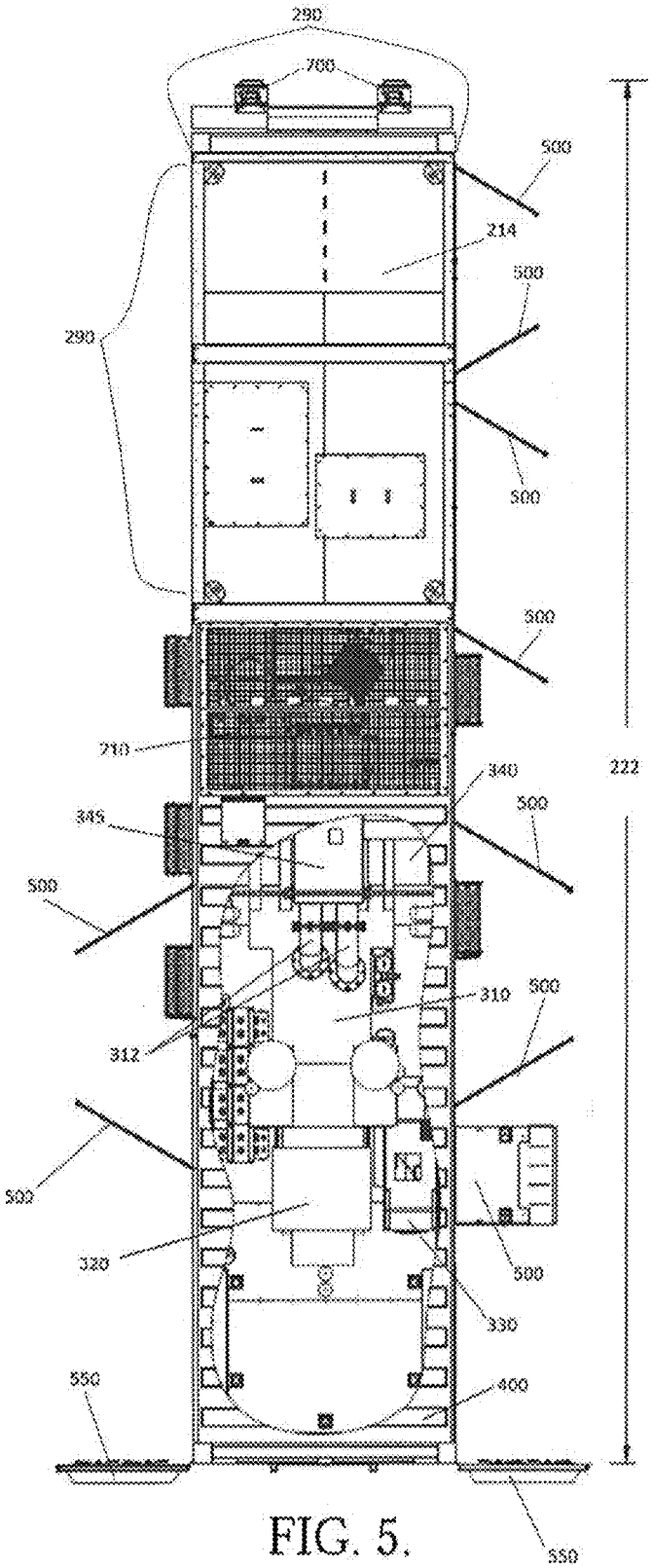
FIG. 5 is a top view of the power system of FIG. 2 with cutaway view into a portion of the interior.
Figure 6:
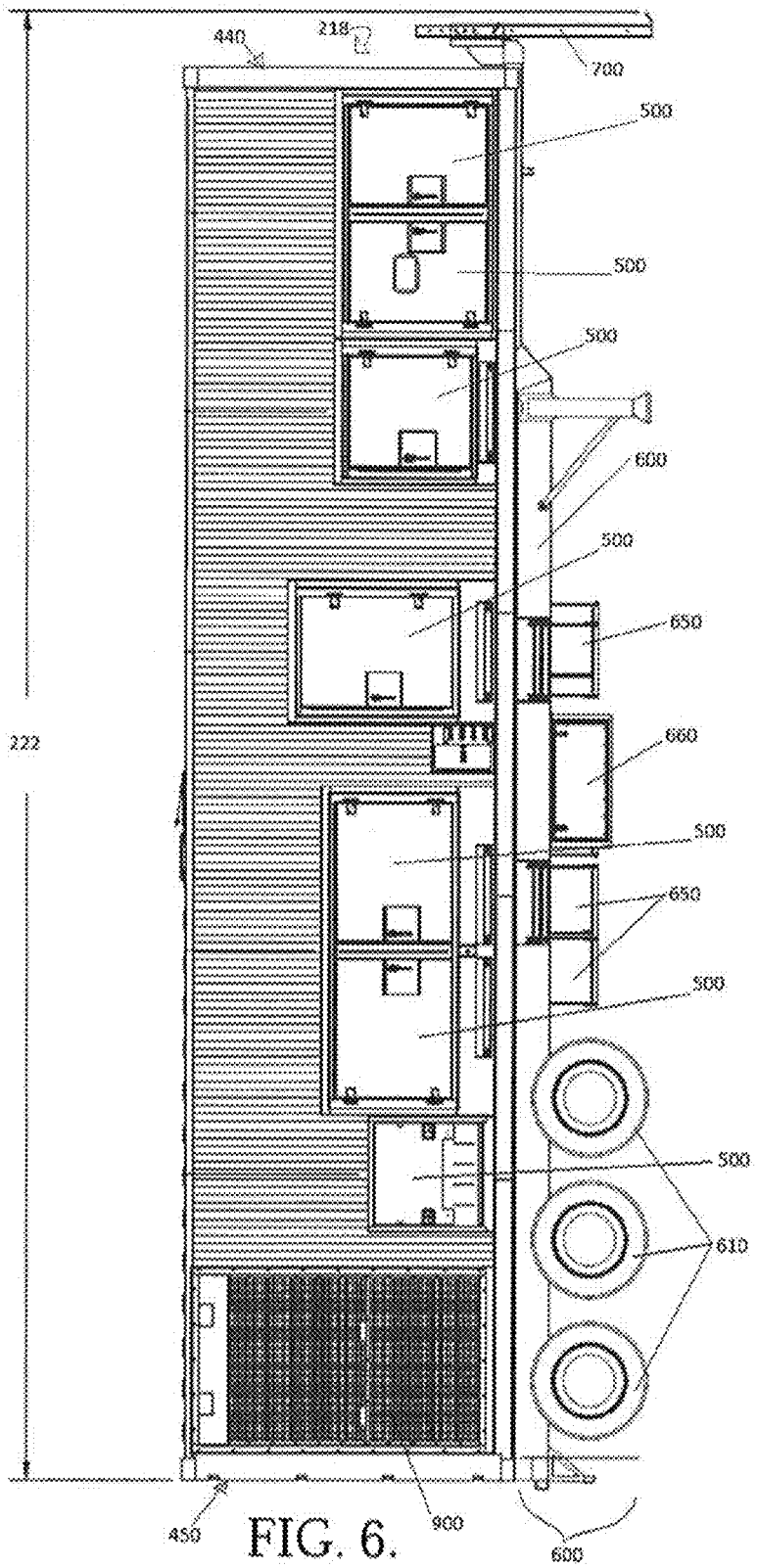
FIG. 6 is a side view of the housing of the power system of FIG. 2.

As shown in FIG. 4, the housing 218 may further comprise a top surface 400, a bottom surface 410, a left side 420, a right side 430, and, as shown in FIG. 6, a front side 440 and a back side 450. In certain embodiments the top surface 400 defines an opening 290 therein, as shown in FIGS. 2, 5, 7 and 8. The opening 290 may be adapted to allow the aftertreatment module 214 to be installed and/or removed there through, as shown in FIG. 7. In the embodiments shown in FIGS. 2 and 4-9, the sides 400, 420, 430 and 440 are covered at least partially in corrugated steel or aluminum sheet typical of an ISO container 220. As shown in FIG. 8, one or more ladders 800 may be attached to or built into the housing 218. As shown in FIG. 9, the interior floor 295 of the housing 218 may be overlaid with a slip-resistant surface, such as aluminum diamond plate, with or without an anti-skid coating. The interior walls 296 (including the interior ceiling) of the housing 218 may comprise smooth powder-coated perforated aluminum over soundproofing material such as mineral wool to attenuate noise. One or more fire extinguishers 297 may be provided in or on the power generation system 200.

As shown in FIG. 5, the housing 218 may include one or more access doors 500, as well as rear doors 550, which may be sized and placed so that all parts of the mobile power generation system 200 can be readily serviced, removed, or replaced. The housing 218 may be placed on a chassis 600 having wheels 610, as shown in FIG. 6. Chassis 600 may in certain embodiments be, by way of specific example, a 40 foot ISO container tri-axle chassis equipped with air ride, anti-lock brakes, 140,000 pound static load landing gear, and 27,000 pound side load landing gear. These are just examples; other features and specifications can be used as will be evident to those of skill in the art. The chassis 600 may include one or more sets of steps 650, such as slide-out, under-chassis aluminum two-step ladders, as well as chassis-connected storage compartments 660. As shown in FIG. 7, the chassis 600 may further include one or more chassis-mounted stabilizer jacks 700. A upper vent 710 may be mounted to the upper portion of the housing 218 to vent heat from the engine 310 and radiator 340 as well as to vent the exhaust gases from the engine 310. The upper vent 710 may comprise a fully removable sectional screen. As shown in FIG. 9, the housing 218 may include one or more side vents 900, which in certain embodiments may be sight proof, rain resistant, inlet louvers sized according to the demands of the engine 310 and radiator 340. Side vents 900 are shown removed in FIG. 9. One or more electrical connection zones 910 may be provided in the exterior of the housing 218 from which a user can draw power from the power system 200, for instance where it is a power generation system. In one embodiment where the power system 200 is a power generation system that provides 1000 kilowatts, the electrical connection zones 910 may provide a maximum output voltage of 480V three phase electricity via three 18 inch load lugs, as well as conventional household-type 120V receptacles, for instance.

Power systems 200 with internally integrated aftertreatment modules 214 and other modular features, such as container modules 350 that can be removed from and replaced in the system 200 as units, and such as power sources 310 and power modules 320 that can together be removably attachable as a single unit 300 to the power system 200, provide many benefits over existing power systems having separate and/or external aftertreatment elements. Space is conserved, and shipping, set-up and maintenance is easier, quicker, and less expensive. When a presently disclosed power system 200 has an aftertreatment module 214 wholly integrated inside a single ISO shipping container 220, the system 200 may easily be transported around the world via standard shipping methods. The time and expense of obtaining special permits to transport multiple or non-conforming containers 220 is avoided. Also, engines, generators and other power equipment can easily be changed. The system 200 is thus easily portable between different locations and power systems.

The above description of the disclosed embodiments is provided to enable persons skilled in the art to make or use the invention. Various modifications to these embodiments will be readily apparent to those skilled in the art, and the generic principles defined herein can be applied to other embodiments without departing from the spirit or scope of the invention. Thus, the invention is not intended to be limited to the embodiments shown herein but is to be accorded the widest scope consistent with the principles and novel features disclosed herein. Other aspects, objects, and advantages of this invention can be obtained from a study of the drawings, the disclosure, and the appended claims.

What is claimed is:

1. A power system adapted to be transported as a single unit, comprising:

a power source that consumes a fuel and exhausts a gas and is capable of generating at least 100 kilowatts of brake power;

a power module comprising an electrical generator capable of generating at least 100 kilowatts of electrical power (kWe) and adapted to be driven by the power source; and a housing that contains the power source, the power module, a first container module adapted to contain the fuel consumed by the power source, an aftertreatment system adapted to purify the gas exhausted from the power source, and a second container module adapted to contain a reductant consumed by the aftertreatment system;

wherein the power source and power module are removably attachable as a single unit to the power system; and wherein the housing has outer dimensions that are sufficiently similar to the outer dimensions of an ISO shipping container to permit the housing to be stacked with ISO shipping containers.

2. The power system of claim 1, wherein the power module further comprises at least one of:

a pump;

a chipper;

a chiller.

3. The power system of claim 1, wherein the first container module is removably attachable as a single unit to the power system.

4. The power system of claim 3, wherein the first container module comprises a fuel tank having a cross-section with an outer perimeter that defines a non-rectangular polygonal shape.

5. The power system of claim 1, wherein second container module is removably attachable as a single unit to the power system.

6. The power system of claim 5, wherein the second container module comprises a reductant tank having a cross-section with an outer perimeter that defines a non-rectangular polygonal shape.

7. The power system of claim 1, wherein the housing shares the outer dimensions of an ISO shipping container.

8. The power system of claim 1, wherein the aftertreatment system comprises at least one of:

a Particulate Filter (PF) system;

an Oxidation Catalyst (OC) system;

a Selective Catalytic Reduction (SCR) system.

9. The power system of claim 1, wherein the power source expels heat to a radiator, and wherein the housing is generally elongated along a longitudinal axis, and has a first end portion near one end of the longitudinal axis, a second end portion near the opposite end of the longitudinal axis, and a middle portion between the first and second end portions, wherein the power source is positioned near either the first end portion or the second end portion, and the radiator is positioned near the middle portion.

10. The power system of claim 1, wherein the aftertreatment system is removably attachable as a single unit to the power system.

11. The power system of claim 1, wherein the aftertreatment system comprises at least one of:

a Particulate Filter (PF) system;

an Oxidation Catalyst (OC) system;

a Selective Catalytic Reduction (SCR) system.

12. The power system of claim 1, further comprising:

a Selective Catalytic Reduction (SCR) system adapted to purify the gas exhausted from the power source; and a source of on-site electrical power internal to the power system and sufficient to properly start up or properly shut down the Selective Catalytic Reduction (SCR) system without a supply of power external to the power system.

13. The power system of claim 12, wherein the internal source of on-site electrical power comprises at least one battery.

14. The power system of claim 13, further comprising at least one of:

an alternator driven by the power source and adapted to charge the at least one battery;

a solar panel adapted to charge the at least one battery;

a wind-driven alternator adapted to charge the at least one battery.

15. The power system of claim 12, further comprising a source of on-site pneumatic power internal to the power system and adapted to purge reductant from reductant transmission lines in the Selective Catalytic Reduction (SCR) system while shutting down the Selective Catalytic Reduction (SCR) system without a supply of power external to the power system.

* * * * *